United States Patent [19]

Penninger

[11] Patent Number: 4,636,359

[45] Date of Patent: Jan. 13, 1987

[54] METHOD FOR INHIBITING CORROSION OF ZINC USING BIS-TRIAZOLES

[75] Inventor: Josef Penninger, Hilden, Fed. Rep. of Germany

[73] Assignee: Henkel Kommanditgesellschaft auf Aktien, Duesselforf, Fed. Rep. of Germany

[21] Appl. No.: 661,536

[22] Filed: Oct. 16, 1984

[30] Foreign Application Priority Data

Oct. 27, 1983 [DE] Fed. Rep. of Germany ..... 3338952

[51] Int. Cl.[4] ..... C23F 11/06; C23F 11/16; C23F 11/14

[52] U.S. Cl. ..... 422/13; 422/16; 252/390; 252/391

[58] Field of Search ..... 422/14, 15, 16, 12, 422/13; 252/388, 389.2, 389.24, 390, 394, 395, 397

[56] References Cited

U.S. PATENT DOCUMENTS

| | | | |
|---|---|---|---|
| 2,836,557 | 5/1958 | Hughes | 252/8.55 |
| 3,408,307 | 10/1968 | Troscinski et al. | 252/394 |
| 3,452,038 | 6/1969 | Randall et al. | 260/308 |
| 4,298,568 | 11/1981 | Gerhardt et al. | 422/16 |
| 4,329,381 | 5/1982 | Eschwey et al. | 252/391 |
| 4,450,137 | 5/1984 | Thompson et al. | 422/16 |

FOREIGN PATENT DOCUMENTS

| | | | |
|---|---|---|---|
| 0102237 | 9/1978 | Japan | 422/16 |

OTHER PUBLICATIONS

Willems et al., "The Preparation of 5-Substituted 1,2,4-Triazoline-3-Thiones and of Alkylene and Arylene 5,5'Bis-1,2,4-Triazoline-3-Thiones", Bull. Soc. Chim. Belges, 75, 358-365 (1966).

Chemical Abstracts, vol. 65, No. 8, Oct. 10, 1966, col. 12204.

"General Chemistry," Markham and Smith, Houghton Mifflin Company, Cambridge Massachusetts (1954) pp. 439-440, and 431-437.

*Primary Examiner*—S. Leon Bashore
*Assistant Examiner*—Andrew J. Anderson
*Attorney, Agent, or Firm*—Ernest G. Szoke; Henry E. Millson, Jr.; Mark A. Greenfield

[57] ABSTRACT

A method of inhibiting zinc corrosion in aqueous systems comprising adding an effective amount of a bis(aminotriazole) or a bis(mercaptotriazole), whose bridge may be substituted by a $C_{0-10}$-alkyl.

19 Claims, No Drawings

METHOD FOR INHIBITING CORROSION OF ZINC USING BIS-TRIAZOLES

BACKGROUND OF THE INVENTION

1. Field of the Invention

This invention relates to the use of certain bis-triazoles as corrosion inhibitors for zinc.

2. Statement of the Prior Art

Previously, only a very few compounds have proved suitable for inhibiting the corrosion of zinc. The compounds in question are, in particular, heterocyclics such as benzotriazole, and tolyl triazole, mercaptobenzothiazole or benzimidazole. Although these known products are extremely effective, they also have various disadvantages, such as poor processability, inadequate shelf life and, in some cases, high toxicity. Moreover, as chemical compounds, they are relatively difficult to obtain and, for economic reasons, can only be used to a limited extent. In addition, in cases where these compounds are used in practice, deposits on the zinc surface occur relatively frequently.

DESCRIPTION OF THE INVENTION

It has now been found that at least one bis-triazole corresponding to the following general formula

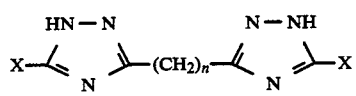

(I)

in which X is an amino or mercapto group and n represents the number of methylene groups in the molecule, or at least one water soluble salt thereof may be used with outstanding results as corrosion inhibitors for zinc in aqueous systems having a pH-range from 6 to 11.

Other than in the operating examples, or where otherwise indicated, all numbers expressing quantities of ingredients or reaction conditions used herein are to be understood as modified in all instances by the term "about".

It has also been found that compounds in which the number of methylene groups (n) is between 0 and 10, preferably between 0 and 6, and in which X is either amino or mercapto, are particularly suitable. Water soluble salts of the bis-triazoles corresponding to general formula (I) may also be used with equally good results. In this respect, both organic acids, such as acetic acid, and inorganic acids, such as hydrochloric acid, sulfuric acid and phosphoric acid, may be used for salt formation.

The effectiveness of the claimed compounds as corrosion inhibitors for zinc is all the more remarkable insofar as it has been found that even monotriazoles are only suitable for inhibition when used in relatively high concentrations. The corrosion inhibition values of monotriazole comparison products, such as 3-heptyl-5-amino-1,2,4-triazole and 3-heptyl-5-mercapto-1,2,4-triazole, are 97% and 94%, respectively, but only when used in concentrations of 100 g/m$^3$. Corrosion inhibition values drop drastically to only 69% and 66%, respectively, when using a monotriazole at a concentration of 20 g/m$^3$. In striking contrast, in the same tests, the bis-triazoles according to this invention produced inhibition values in excess of 90 %, even when used in a concentration of 10 g/m$^3$.

The bis-triazoles according to this invention may be used in any corrosion inhibitive effective amount.

The quantity of bis-triazole which is best added is between 0.1 and 50 g per m$^3$ of aqueous media and preferably between 1 and 10 g/m$^3$. The corrosion inhibitors can be applied in the form of aqueous solutions, dispersions or emulsions, with or without non-interactive adjuvants.

The bis-triazoles are produced by methods known per se, for example by reacting $\alpha,\omega$-dicarboxylic acids with 2 moles of aminoguanidine or, in the case of the bis-mercaptotriazoles, by reacting $\alpha,\omega$-dicarboxylic acid esters with 2 moles of thiosemicarbazide. However, the production of the bis-triazoles is not the subject of the invention.

EXAMPLES A–F

The corrosion inhibiting properties were determined as follows:

Three carefully pretreated and weighed test strips (zinc 99.5, 80×15×1 mm) are suspended in a 1 liter test vessel containing 800 ml of test water, 30 ml of buffer solution and a predetermined quantity of the corrosion inhibitor to be tested and left therein for 6 hours at room temperature/80 revolutions per minute.

The corrosion inhibition value S, based on a blank test specimen, was calculated from the weight loss.

| | |
|---|---|
| $S = 100(1 - a/b)$ | a = weight loss test specimen<br>b = weight loss blank value |

The test water used as the corrosive medium was prepared in accordance with Deutsche Industrienorm (DIN) 51 360/2 and buffered with ammonia/ammonium chloride.

The compounds used for conducting the corrosion inhibition tests are listed in Table 1, "n" and "X" being defined with reference to formula I.

TABLE 1

| | A | B | C | D | E | F |
|---|---|---|---|---|---|---|
| n | 0 | 4 | 6 | 0 | 4 | 6 |
| X | $NH_2$ | $NH_2$ | $NH_2$ | SH | SH | SH |

The corrosion inhibition values obtained are shown in Table 2 below.

TABLE 2

| Dosage | Corrosion inhibition value S in % | | | | | | |
|---|---|---|---|---|---|---|---|
| (g/m$^3$) | A | B | C | D | E | F | G |
| 10 | 97 | 95 | 98 | 99 | 93 | 91 | 81 |
| 5 | 97 | 95 | 98 | 99 | 85 | 78 | 77 |
| 1 | 95 | 95 | 98 | 99 | 54 | 78 | 48 |

"G" is benzo (mono) triazole and was used as a comparative example.

ANALYSIS AND DISCUSSION OF TABLES 1 AND 2

Assuming a minimum acceptable S value of 85%, preferably 90%, most preferably 95%, it will be noted that all compounds according to this invention fall within the preferred range at 10 g/m$^3$ concentration, as contrasted with the poor 81% value for the monotriazole G. Similarly, all compounds according to this invention in which X is amino as well as the example where X is mercapto and n is 0, yield most preferred results. The results for Example C (where X is amino and n is 6) and Example D (where X is mercapto and n is 0) are considered outstanding, particularly because their corrosion inhibiting efficacy is not reduced even when the dosage is lowered to at least 1 g/m$^3$. Examples E and F, although not as effective as the other tested compounds, may still be useful in dosages as low as 5 g/m$^3$ (Ex. E) or 10 g/m$^3$ (Ex. F), depending upon the cost of material factors, particularly since they are still more effective than the prior art monotriazoles.

I claim:

1. A method of inhibitng the corrosion of zinc by an aqueous system comprising adding to said system a corrosion inhibitive effective amount of at least one compound, or at least one water soluble salt thereof, having the formula

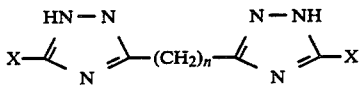

wherein:

X is $NH_2$ or SH, and n is 0 to 10.

2. The method of claim 1 wherein n is 0 to 6.

3. The method of claim 1 wherein n is 0, 4 or 6.

4. The method of claim 3 wherein X is $NH_2$.

5. The method of claim 1 wherein X is SH.

6. The method of claim 1 wherein X is $NH_2$ and n is 6.

7. The method of claim 1 wherein X is SH and n is 0.

8. The method of claim 1 wherein X is $NH_2$ and n is 0.

9. The method of claim 1 wherein X is $NH_2$ and n is 4.

10. The method of claim 1 wherein X is SH and n is 4.

11. The method of claim 1 wherein X is SH and n is 6.

12. The method of claim 1 wherein said at least one compound is a salt of an organic acid or an inorganic acid.

13. The method of claim 12 wherein said acid is acetic, hydrochloric, sulfuric, or phosphoric.

14. The method of claim 1 wherein said aqueous system has a pH of about 6 to 11.

15. The method of claim 1 wherein said at least one compound is added to said aqueous system in an amount of about 0.1 to 50 g/m$^3$.

16. The method of claim 1 wherein said at least one compound is added to said aqueous system in an amount of about 1 to 10 g/m$^3$.

17. The method of claim 2 wherein said at least one compound is added to said aqueous system in an amount of about 1 to 10 g/m$^3$.

18. The method of claim 4 wherein said at least one compound is added to said aqueous system in an amount of about 1 to 10 g/m$^3$.

19. The method of claim 5 wherein said at least one compound is added to said aqueous system in an amount of about 1 to 10 g/m$^3$.

* * * * *